US005471437A

United States Patent [19]

Schutter et al.

[11] Patent Number: 5,471,437

[45] Date of Patent: Nov. 28, 1995

[54] ELECTRODYNAMIC ACOUSTIC TRANSDUCER

[75] Inventors: Ernst Schutter; Vladimir Gorelik, both of Hanover, Germany

[73] Assignee: Sennheiser electronic KG, Wedemark, Germany

[21] Appl. No.: 298,378

[22] Filed: Aug. 30, 1994

[30] Foreign Application Priority Data

Sep. 4, 1993 [DE] Germany ..... 43 29 982.2

[51] Int. Cl.[6] ..... G10K 13/00

[52] U.S. Cl. ..... 367/175; 181/165; 181/163; 381/185; 381/202

[58] Field of Search ..... 181/165, 144, 181/157, 163, 164, 171; 381/185, 202, 184, 186, 194; 367/175, 182

[56] References Cited

U.S. PATENT DOCUMENTS 3,328,537 6/1967 Hecht ..... 181/163
5,027,411 6/1991 Hill ..... 381/160
5,283,397 2/1994 Pavlovic ..... 181/163
5,339,286 8/1994 Esposto ..... 367/140

*Primary Examiner*—J. Woodrow Eldred
*Attorney, Agent, or Firm*—McAulay Fisher Nissen Goldberg & Kiel

[57] ABSTRACT

An electrodynamic transducer has a diaphragm substantially having two parts with different profiles, namely an acoustically active central part and an annular part laterally adjoining the central part and serving for the resilient suspension of the diaphragm in its entirety. A narrow coil seat for a wire coil of the transducer is located between the central part and the annular part. For the purpose of developing a compact yet electrodynamically sensitive acoustic transducer, the annular part is not arranged radially outside the central part of the diaphragm, but is shifted inward according to the invention. The curved annular part is thus accommodated under the axial curvature of the central part. The annular part can therefore have the annular width required for an ideal resilient suspension without negatively affecting the outer dimensions of the transducer.

2 Claims, 2 Drawing Sheets

FIG. 2
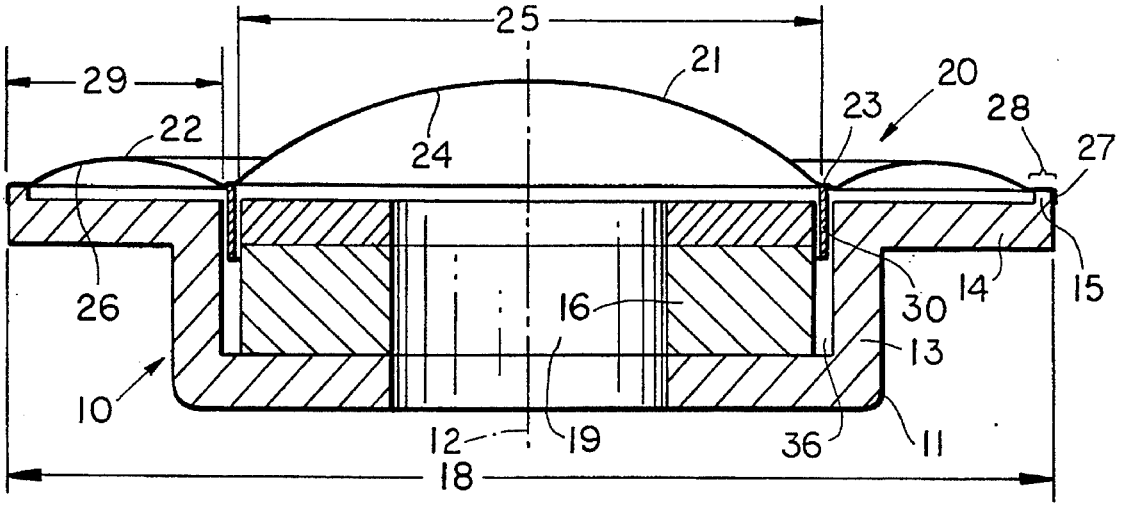
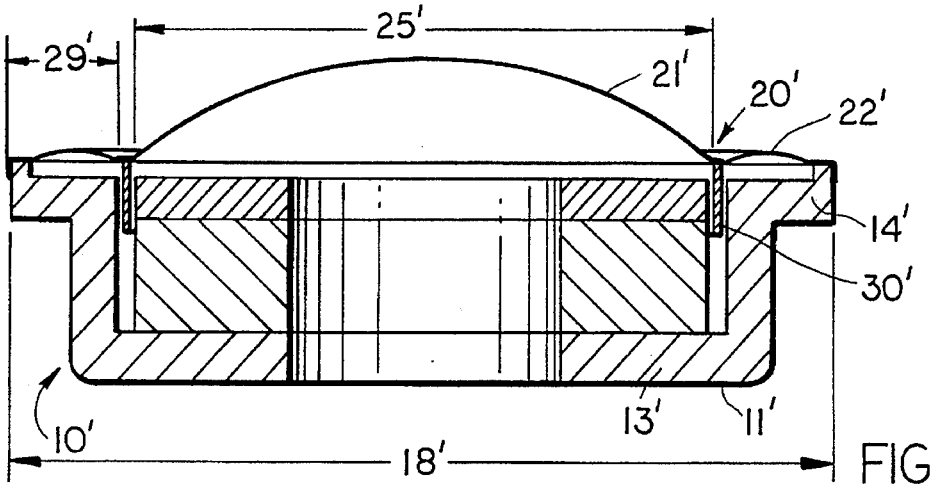
FIG. 3
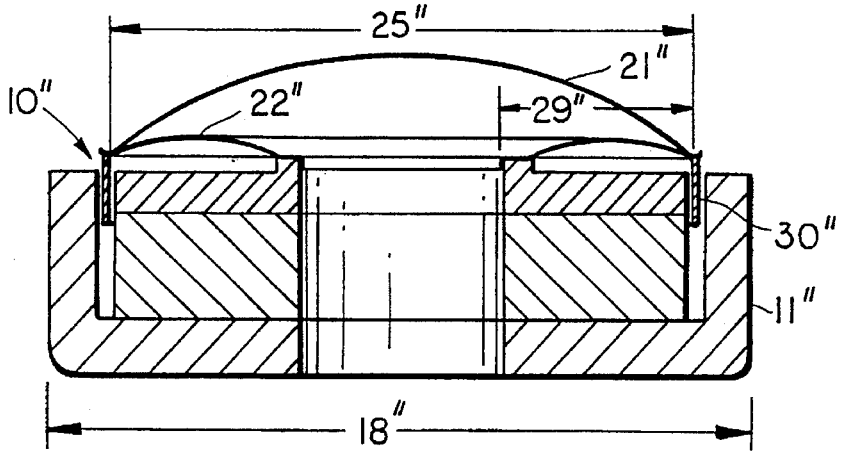
FIG. 4

ELECTRODYNAMIC ACOUSTIC TRANSDUCER

BACKGROUND OF THE INVENTION

The present invention is directed to an electrodynamic acoustic transducer comprising a magnet system and a vibration system formed by a diaphragm and a wire coil supported by the diaphragm. The diaphragm has two differently profiled parts performing distinct operations.

The diaphragm has an acoustically active central part with a domed top, commonly referred to as a cap. This central part is surrounded by a coil seat, the electric coil of the transducer being attached to the latter. An annular part which provides for the resilient suspension of the diaphragm and has, e.g., a curved profile, proceeds from the shoulder. This annular part is commonly referred to as a bead. Seemingly contradictory requirements must be satisfied in order to achieve optimal operation of the central part and annular part.

In order to achieve a high degree of sensitivity in the electrodynamic acoustic transducer, the diameter of the acoustically active central part should be as large as possible. Further, it is desirable to make the central part as rigid as possible for a good acoustic effect. Only in this way can an effective interaction be ensured between the central part and the air which acts as an acoustical medium, regardless of whether the transducer is used as an acoustic receiver or as an acoustic transmitter. The rigidity of the annular part must be as slight as possible in order to ensure a good axial movability of the central part. For this purpose, the annular part must also be constructed with a relatively large annular width. In known acoustic transducers, the annular part is arranged radially outside the central part and hence adds to the diameter of the central part. As a result, diaphragms in the known transducers had large dimensions which could not be reconciled with the given limited dimensions of a transducer casing so that it was necessary to reach a technical compromise: either the dimensions of the central part and accordingly the dimensions of the coil had to be reduced or the annular part had to be constructed with a smaller annular width.

OBJECT AND SUMMARY OF THE INVENTION

The primary object of the present invention is to develop an acoustic transducer of the type which has the smallest possible dimensions but which nevertheless satisfies the seemingly conflicting demands of high sensitivity and extensive axial movability of the diaphragm. This object is met, according to the invention, by the electrodynamic transducer includes a diaphragm substantially having two parts with different profiles. The two parts include an acoustically active central part with a domed top or cap and an annular part or bead for resilient suspension of the diaphragm and which adjoins the central part. The transducer includes a coil seat for a wire coil of the transducer which is arranged in an annular transitional area between said central part and the annular part. The coil seat forms an outer boundary of the central part. The transducer has, as an improvement, an arrangement wherein the coil seat additionally forms an outer boundary of the annular part and determines the maximum outer diameter of the diaphragm in its entirety. Further, the annular part is arranged below the domed top of the central part so as to be offset axially thereto and extends inward radially proceeding from the coil seat.

The invention departs from the principle of construction previously applied in the prior art whereby the annular part of the diaphragm was always arranged radially outside the central part of the diaphragm. In the present invention, the annular part is arranged axially below the central part and accordingly extends inward radially as considered from the coil seat. Thus the two diaphragm parts are not radially adjacent as in the prior art, but rather are arranged axially one above the other. Accordingly, it is possible either to build the transducer with smaller dimensions or to use electric coils having greater dimensions than were hitherto employed while retaining the dimensions of the prior art transducer. The latter alternative enables transducers of higher sensitivity. This also provides new possibilities for application in the domain of headphones or earphones; that is, dimensions may now be reduced to such an extent while maintaining relatively good fidelity of reproduction that an "inside-the-ear" effect is even possible. Further steps and advantages are indicated in the claims, the following description and the drawings. The drawing shows two embodiment examples of the invention.

BRIEF DESCRIPTION OF THE DRAWINGS

In the drawings:

FIG. 2 shows the known construction principle applied in the prior art in a corresponding axial section through a portion of a transducer;

FIG. 3 is a view corresponding to FIG. 2 showing a transducer as it was constructed in the prior art in order to maintain acceptable dimensions;

FIG. 4 shows the novel transducer designed according to the construction principle of the invention shown in FIG. 1 in a simplified view analogous to that of FIG. 3 and on the same scale for purposes of comparison with FIG. 3;

DESCRIPTION OF THE PREFERRED EMBODIMENTS

Figure 1:
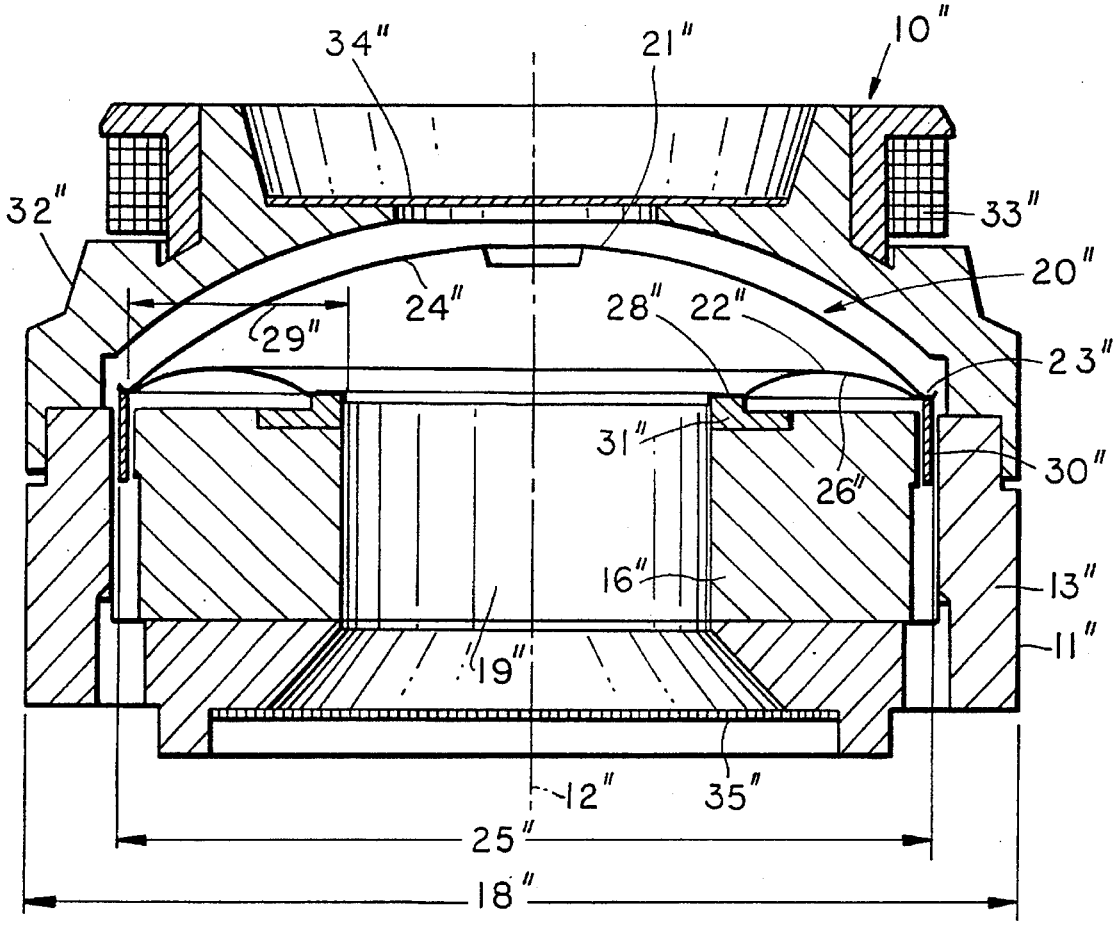
FIG. 1 shows an axial section through an electrodynamic transducer designed according to the invention.

A transducer 10 of the prior art is constructed according to the known principle shown in FIG. 2. FIG. 2 shows only the lower portion 11 of the transducer which serves to support a diaphragm 20. The transducer 10 is symmetrical with respect to rotation with reference to the axis 12 shown in dash-dot lines and has a cup 13 which, owing to the design of the known diaphragm 20 which will be discussed more fully in the following, passes into a radial flange 14 where it terminates in an annular shoulder 15. Located within the cup 13 is a ring magnet 16 whose inner aperture forms an acoustic passage or port 19 which also passes through the casing shell enclosing it. The outer circumference of the ring magnet 16 encloses an annular gap 36 together with the cup 13. A wire coil 30 penetrates into the annular gap 36 when the diaphragm 20 is mounted.

The diaphragm 20 substantially has two parts 21, 22 with different profiles. The actual acoustically active structural component part of the diaphragm is located in the center of the diaphragm and is formed by a central part 21 with a domed top 24. This central part 21 of the diaphragm 20 is commonly referred to as a cap. In order to achieve a transducer 10 with high sensitivity, the diameter 25 of the central part 21 should be as large as possible. At the same time, it is advantageous for good acoustical reproduction or for acoustic reception that the central part 21 be rigid to a degree. However, for reasons which will be explained in the following, strict limits were imposed on the magnitude of the diameter 25 due to the arrangement of the second diaphragm part 22.

As will be seen with reference to FIG. 2, the central part 21 in the known diaphragm 20 is surrounded by an annular part 22 of the diaphragm 20 which extends outward radially. The annular part 22 has a curved profile 26 whose convex side faces in the same direction as the domed curvature 24 of the central part 21 described above. This annular part 22 is commonly referred to as a bead and provides for a resilient suspension of the central part 21 in the transducer casing 11. The outer circumferential edge 27 of the known diaphragm 20 is provided with a flanged fastening edge 28 and is supported at the aforementioned annular shoulder 15 of the transducer casing 11.

A narrow annular zone serving as a coil seat 23 for the aforementioned coil 30 is located in the transitional area between the central part 21 and the annular part 22. The coil 30 is securely connected with the coil seat 23 by its cylindrical end face. Accordingly, when used as an acoustic receiver, axial movements of the central part are transmitted to the coil 30 and, conversely, when used as an acoustic transmitter, axial movements of the coil are transmitted to the central part 21 supporting the coil.

To ensure the desired favorable movability of the central part 21 in reciprocal action with sound, the dimensions of the annular part 22 should also be as large as possible. Accordingly, taking into account the fastening edge 28 which encloses the annular zone, the annular width 29 indicated in FIG. 2 is added to the diameter 25 of the central part 21. As a result, the outer dimensions 18 of the transducer casing 11 are considerable.

Therefore, for reasons pertaining to dimensions, it was necessary in the prior art to modify the transducer 10' in the manner shown in FIG. 3. Corresponding structural component parts in FIG. 3 are designated by the same reference numbers as in the embodiment example of FIG. 2 so that the foregoing description also applies to the transducer 10' unless otherwise noted. These reference numbers are accompanied by a stroke (') to distinguish between the two embodiment examples. The following discussion addresses only the differences between these two examples.

The dimensions 18' of the casing of the transducer 10' in FIG. 3 are reduced as a result of a decrease in the annular width 29' described above with reference to FIG. 3. The annular part 22' serving for the suspension of the central part 21' has correspondingly smaller dimensions so that the axial movability of the annular part 21' compares unfavorably with the transducer 10 described above. In this instance, the diameter 25' of the central part 21' at least has the same dimensions as that of transducer 10 so that acoustic reproduction is not also impaired in comparison with transducer 10 of FIG. 2. It is therefore sufficient to reduce the edge flange 14' in the modified transducer 10' of FIG. 3 in conformity to the reduced outer dimensions 18'. If the diameter 25' of the central part were reduced, it would be necessary to resort to a correspondingly smaller coil 30' which would result in decreased sensitivity of the acoustic transducer 10'. Thus, as illustrated in FIG. 3, there must be a trade-off between the dimensions 25' and 29' of the two diaphragm parts 21' and 22' used in the construction of this known diaphragm 20' in the interest of the restricted maximum outer dimensions 18'.

As shown in FIG. 1, the invention follows an entirely novel path in the construction of the transducer 10'. Corresponding structural component parts in FIG. 1 are designated by the same reference numbers as those used for transducer 10 in FIG. 2, but are accompanied by a double-stroke (") to distinguish them from one another. The preceding description may also be referred to unless otherwise noted. The critical difference between the transducer 10" according to the invention and that of the prior art consists in the different construction of the diaphragm 20".

In the diaphragm 20" according to the invention, the two diaphragm parts 21", 22" are not located radially adjacent to one another, but rather are offset axially as viewed along axis 12" in FIG. 1. In diaphragm 20", also, it is the coil seat 23" which defines the outer boundary of the central part 21"; but this coil seat 23" at the same time determines the maximum outer diameter 25" of the diaphragm in its entirety. Whereas the annular part 22 adjoins the coil seat 23' radially at the outside in the known transducer 10 according to FIG. 2, the annular part 22" in the transducer 10" according to the invention shown in FIG. 1 extends inward radially. The curved profile 26" of the annular art 22" is located entirely within the curved region 24" of the central part 21". The fastening edge 28" of the diaphragm, which in this instance is also located at the free edge of the annular part 22", no longer forms the outermost boundary of the diaphragm as in FIG. 2, but faces inward radially. The annular width 29" resulting in diaphragm 20" according to the invention no longer adds to the diameter 25" of the central part as in the known transducer 10 of FIG. 2. This annular width 29" has no effect on the outer dimensions 28" of the lower portion 11" of the transducer casing shown in FIG. 1.

The ring magnet 16", which is also shown in FIG. 1, supports an annular shoulder 31", e.g., a ring which is recessed therein, serving to support the fastening edge 28" of the diaphragm for fastening purposes. The annular shoulder 31" encloses the axial acoustic port 19" in the transducer casing 11". FIG. 1 also shows the upper part 32" of the transducer associated with the lower part 11" of the transducer. The housing shell 13" which is associated with the lower portion 11" of the transducer and has already been described tapers off cylindrically into a cylindrical projection of the upper part 32" of the housing while maintaining small outer dimensions 18". FIG. 1 shows the use of the transducer 10" as a microphone. The upper part 32" of the transducer supports a compensating coil 33". Both apertures of the axial acoustic port 19" opening into the two transducer parts 11", 32" are covered by acoustic resistors 34", 35".

FIG. 4 shows the transducer 10", according to the invention, with the corresponding structural component parts and in the same scale as the transducer 10' of the prior art according to FIG. 3. It is assumed that the two central parts 21' and 21" to be compared have the same diameter 25' and 25". Since the annular part 22" in FIG. 4 is shifted inward, the outer dimensioning 18" of the transducer 10" according to the invention is substantially smaller. The lateral flanges 14' provided in the known transducer 10' shown in FIG. 3 are not provided in the transducer casing 11" according to the invention. Nevertheless, the annular width 29" shown in FIG. 4 is substantially greater than the corresponding annular width 29' in the known transducer 10' shown in FIG. 3. This results, on the one hand, in the substantial improvement of the resilient suspension of the central part 21" by means of the annular part 22" in the transducer 10" according to the invention as discussed above and, on the other hand, in an extensive axial movability of the central part 21" when interacting with the acoustic medium.

Figure 5:
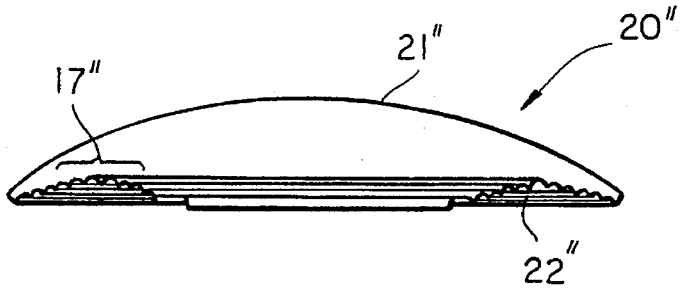
FIG. 5 shows a diaphragm for the transducer according to the invention prior to installation in a transducer casing in an alternative construction to that of FIG. 1.

FIG. 5 shows a modified diaphragm 20" according to the invention prior to installation in the transducer. The modification consists in that the annular part 22" is provided additionally or alternatively with corrugated deformations 36". This improves the axial movability of the central part 21".

What is claimed is:

1. In an electrodynamic acoustic transducer with a diaphragm substantially having two parts with different profiles, namely an acoustically active central part with a domed top and an annular part for resilient suspension of the diaphragm and which adjoins the central part, wherein a coil seat for a wire coil of the transducer is arranged in an annular transitional area between said central part and said annular part, said coil seat forming an outer boundary of the central part, the improvement comprising that said coil seat additionally forms an outer boundary of the annular part and determines the maximum outer diameter of the diaphragm in its entirety, and that the annular part is arranged below the domed top of the central part so as to be offseat axially thereto and extends inward radially proceeding from the coil set.

2. The transducer according to claim 1, wherein said annular part has a curved profile with corrugated deformations therein.

* * * * *